US005937648A

United States Patent [19]

Hirose et al.

[11] Patent Number: 5,937,648

[45] Date of Patent: Aug. 17, 1999

[54] GAS COMPRESSION/EXPANSION APPARATUS

[75] Inventors: Tatsuya Hirose, Oizumi-machi; Kazuo Ikegami, Takatsuki; Seiji Ikeda, Okayama, all of Japan

[73] Assignee: Sanyo Electric Co., Ltd., Osaka, Japan

[21] Appl. No.: 08/806,404

[22] Filed: Feb. 26, 1997

[30] Foreign Application Priority Data

| | | | |
|---|---|---|---|
| Feb. 29, 1996 | [JP] | Japan | 8-067505 |
| Jan. 31, 1997 | [JP] | Japan | 9-031516 |
| Feb. 10, 1997 | [JP] | Japan | 9-039731 |

[51] Int. Cl.[6] ..... F01B 29/10

[52] U.S. Cl. ..... 60/523; 60/517

[58] Field of Search ..... 60/517, 523; 184/6.5, 184/6.6, 6.8

[56] References Cited

U.S. PATENT DOCUMENTS

| | | | |
|---|---|---|---|
| 4,257,230 | 3/1981 | Lundholm | 60/517 |
| 4,381,648 | 5/1983 | Balas, Jr. | 60/517 |
| 4,483,141 | 11/1984 | Kobayashi et al. | 60/517 |
| 5,056,419 | 10/1991 | Watanabe et al. | 60/517 X |
| 5,085,054 | 2/1992 | Katsuda et al. | 60/517 |

*Primary Examiner*—Hoang Nguyen

*Attorney, Agent, or Firm*—Armstrong, Westerman, Hattori, McCleland & Naughton

[57] ABSTRACT

The gas compression/expansion apparatus comprises: a working section for compressing/expanding therein a working gas by pistons each connected with a rod; a drive section including sliders each connected at one end thereof with the rod and connected at one end thereof with a guide for guiding the slider, and a drive mechanism for reciprocating the sliders; and a separator for fluid dynamically separating the working section from the drive section, the separator permitting said rod to pass through said separator. The separator further includes an oil seal arrangement. Formed inside the separator is an intermediate chamber which allows the rod to pass there through. The inner radius of the intermediate chamber is greater than the radius of the rod plus the oil deposited on the rod. The guide includes a guide space formed such that the distance between the slider at its upper dead point and the wall of the separator facing the slider is larger than the thickness of the oil on the slider. The separator also includes an oil return passage for allowing the oil accumulated in the guide space to return to an oil sump. The oil seal arrangement may prevent the oil on the guide from coming into direct contact with the separator and prevent the oil on the rod from entering the working section.

19 Claims, 12 Drawing Sheets

GAS COMPRESSION/EXPANSION APPARATUS

FIELD OF THE INVENTION

The invention relates to a gas compression/expansion apparatus for compressing/expanding a working gas by reciprocal pistons, and in particular to such gas compression/expansion apparatus equipped with an improved oil seal arrangement.

KNOWN ART

Gas compression/expansion apparatuses have been utilized in Stirling freezers, Stirling engines as well as in reciprocal compressors. A typical gas compression/expansion apparatus, designated generally as 100 in FIG. 14 has a piston 111 for compressing/expanding a working gas in a working section 110 and a drive section 120 for driving the piston 111. The working section 110 is separated from the drive section 120 by a separation wall or separator 130. A crank mechanism 121 of the drive section 120 has a crank arm 122 which is connected with a slider 123, which is in turn connected with a rod 140 of the piston 111 through the separator 130.

Thus, as the rotational motion of a motor in the drive section is transformed into reciprocal motions of the piston 111 by the crank mechanism 121, the working gas in the working section 110 is compressed/expanded.

The crank mechanism 121 is lubricated by oil 124. If the oil 124 infiltrates into the working section 110 and gets mixed with the working gas, gas passages for the working gas can be clogged with the oil. In order to prevent such clogging, there is provide a seal member 131 in the separator 130. The rod 140 is tightly fitted in the seal member so that the oil 124 on the rod may be wiped off from the rod 140.

FIG. 15 shows in more detail a section of the seal member 131 provided in a separator 130. This seal member 131, accumulated in a recessed section 132 of the seal member, is urged by a back-up member 133 to make tight contact with the rod 140. Such an urged seal member will be referred to hereinafter as tight seal member. In contrast, if a seal member has a loose sealing surface, or a finite clearance, it is referred to as non-contacting seal member. The back-up member must normally provide a strong force on the seal member 131 in order to effect good sealing and wipe off excessive oil 124 from the rod 140, since the oil 124 on the rod 140 may be removed well only when the seal member 131 is in tight contact with the rod 140.

Such conventional sealing of lubrication oil as discussed above, however, often suffers from a problem that the sealing member gradually wears away so that its salability is degraded in a long run.

The seal also suffers from another problem that the slider 123 collects thereon oil and carries it to its upper dead point (defined as the position of the slider where the distance of the slider from the working section is minimum), so that part of the oil carried by the slider 123 touches the separator 130, which is eventually carried into the seal member.

After a long run, the oil 124 can accumulates in a space between the slider 123 and the separator 130, which oil may be sputtered by the reciprocating slider 123 on the seal member 131 due to an inertial force acting on the oil.

In all these circumstances the oil 124 is gradually driven by the reciprocating rod 140 into the working section 110, and is eventually mixed with the working gas, so that compression/expansion performance of the apparatus is degraded. Thus, the operability of the apparatus or service life of the apparatus is limited by the sealability of the oil seal member.

To overcome the limitations pertinent to the prior art seal member as describe above, and to overcome other limitations that will become apparent upon reading and understanding the present specification, the invention discloses a reliable and durable oil seal arrangement which is capable of preventing the oil from infiltrating into working sections of a gas compression/expansion apparatus, as described in Japanese Patent Application No. 8-67505 filed on Feb. 29, 1996. The entire disclosure of the Japanese Patent Application including specification, claims, drawings and summary are incorporated herein by reference in its entirety.

SUMMARY OF THE INVENTION

There is provided, in accordance with the present invention, a gas compression/expansion apparatus which comprises:

a working section for compressing/expanding therein a working gas by pistons each connected with a rod;

a drive section including sliders each connected at one end thereof with the rod and connected at one end thereof with a guide for guiding the slider, and a drive mechanism for reciprocating the sliders; and a separator for fluid dynamically separating the working section from the drive section, the separator permitting said rod to pass through said separator.

The separator further includes an oil seal arrangement. Formed inside the separator is an intermediate chamber which allows the rod to pass therethrough. The inner radius of the intermediate chamber is greater than the radius of the rod plus the oil deposited on the rod. The guide includes a guide space formed such that the distance between the slider at its upper dead point and the wall of the separator facing the slider is larger than the thickness of the oil on the slider. The separator also includes an oil return passage for allowing the oil accumulated in the guide space to return to an oil sump.

This oil seal arrangement may prevent the oil on the guide from coming into direct contact with the separator and prevent the oil on the rod from entering the working section.

The above and other objects, features, and advantages of the present invention will become apparent from the following description and the attached drawings.

BRIEF DESCRIPTION OF THE DRAWINGS

Preferred embodiments of the invention will now be described in conjunction with the accompanying drawings, in which:

FIG. 6(*b*) is an enlarged view of the front chamber.

DETAILED DESCRIPTION OF THE PREFERRED EMBODIMENT

Description of Specific Embodiments

Figure 1:
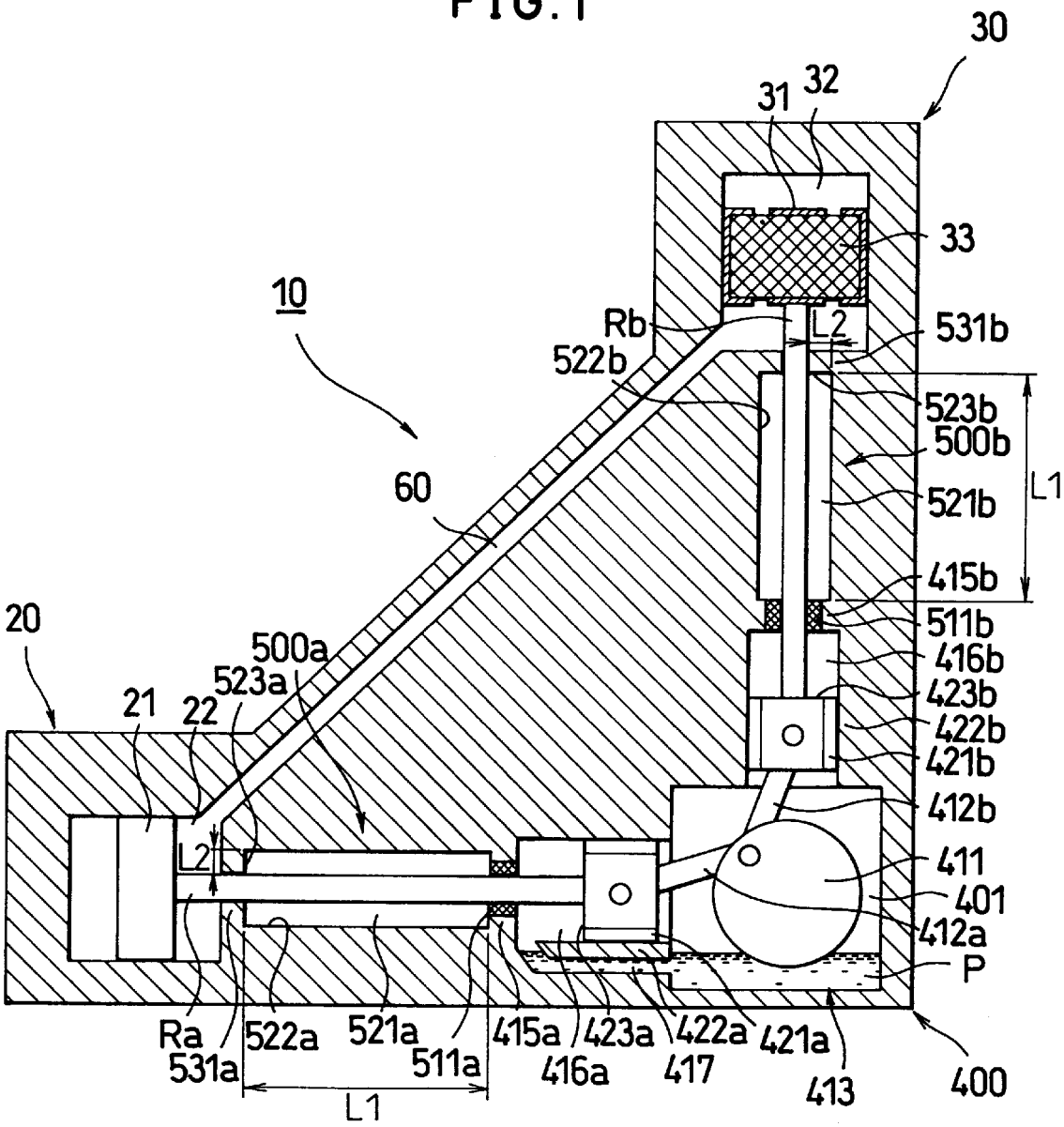
FIG. 1 is a schematic view of an oil seal arrangement of a gas compression/expansion apparatus according to the invention, suitable for a Stirling freezer.

With reference to the accompanying figures, the invention will be now described by way of example, in which like reference characters designate like or corresponding features throughout the figures, and a single reference number refers to a group of equivalent elements. For example, "slider 421" implies either one or both of two equivalent sliders 421*a* and 421*b* involved, unless otherwise stated. Although the invention will be described in detail particularly in a case of a displacer type Stirling freezer equipped with an improved oil seal arrangement. However, it should be understood that the invention may be applied equally well to other types of compression/expansion apparatuses, for example, an expansion piston type Stirling freezer, Stirling engine, and a reciprocal compressor.

Referring now to FIG. 1, there is shown a Stirling freezer 10 having a section 20 (hereinafter referred to as compression section) for compressing a volume of working gas therein, a section 30 (hereinafter referred to as displace section) for allowing the gas therein to expand through a displace so to absorb heat from a heat exchanger, a section 400 (hereinafter referred to as drive section) having a drive mechanism for operating the compressor and the displace, and separators 500 (500*a*, 500*b*) for fluid mechanically separating the drive section 400 from the compression section 20 and displace section 30.

The compression section 20 includes a compression space 22 in which the working gas may be compressed by a compression piston 21 which reciprocates in the compression space 22.

The displace section 30 includes an expansion space 32 in which the working gas may expand through a displace 31 which also reciprocates in the expansion space 32.

The compression section 20 and the displace section 30 are connected with a gas passage 60 for allowing the working gas to go back and force between the compression section 20 and displace section 30 so that the gas may be alternately compressed/ expanded by the piston 21 and the displace 31, respectively while the freezer is in operation. However, it should be understood that both the compression piston 21 and the displace 31 alternately perform compression and expansion processes and that they can be switched in the Stirling freezer 10. Furthermore, the oil seal arrangement of the invention for the compressor and the displace are essentially the same. Thus, it is immaterial to distinguish between them while discussing the oil seal arrangement for them. Therefore we refer to the compression section 20 and displace section 30 collectively as working section 20/30, and the compression space 22 and displace space collectively as working space 22/32 in the following description of the invention unless they need to be distinguished.

The displace 31 has a heat capacitor 33 which contains meshed or spheroidized material, such as copper, lead, and stainless steel, so that the heat capacitor 33 may serve as a cold heat reservoir. As the displace 31 moves towards the drive section 400, the working gas passes through the heat capacitor 33 and liberates heat to the heat capacitor 33. When the displace 31 moves away from the drive section 400, the working gas absorbs heat from the heat capacitor.

The drive section 400 has a drive chamber 401 which contains a crank mechanism 411, a set of slider guides 422 (422*a* and 422*b*) for guiding respective sliders 421 (421*a*, 421*b*) connected with the crank mechanism 411 by respective crank arms 412 (412*a* and 412*b*), an oil sump 413 under the crank mechanism 411 for storing lubrication oil P for the crank mechanism and the sliders 421; and a motor (not shown) for operating the crank mechanism 411.

As the power of the crank mechanism 411 is transmitted to the sliders 421 via the crank arms 412 which are connected with the same pivot of the crank mechanism, the slider guides 422*a* and 422*b* undergo reciprocal motions in synchronism with the rotational motion of the crank mechanism 411.

In the example shown herein the compression piston 21 and the displace 31 are arranged at right angle, so that the compression piston 21 and the displace 31 are out of phase by 90 degrees. Consequently, the compression piston 21 remains virtually stationary when the crank arm 412*a* assumes an approximately horizontal position, while the displace 31 undergoes a large displacement. Conversely, the compression piston 21 undergoes a large displacement and the displace 31 remains virtually stationary when the crank arm 412*b* assumes an approximately vertical position.

Figure 2A:
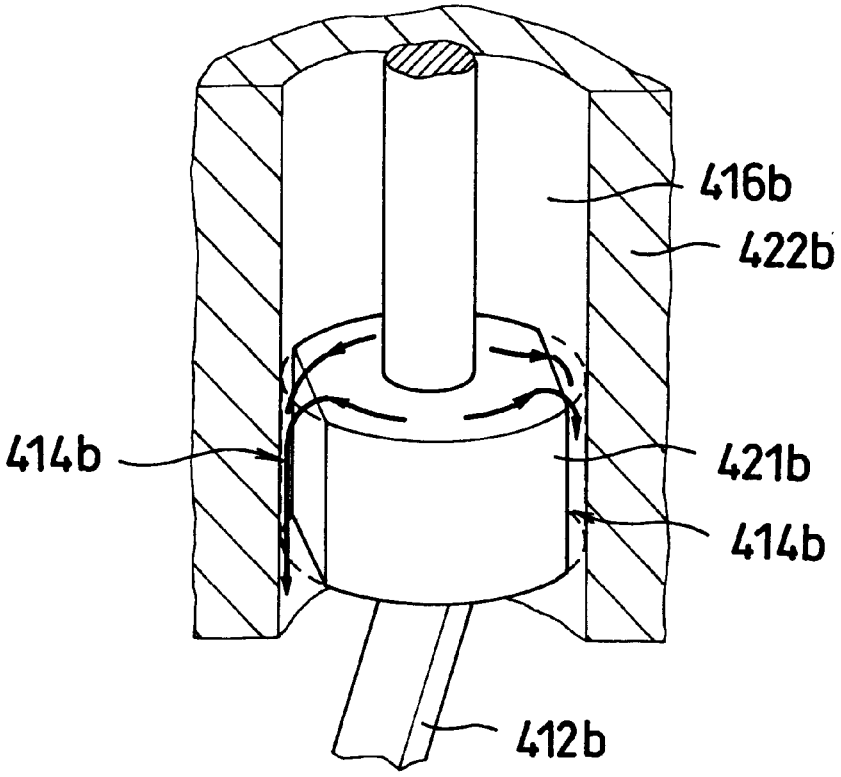
FIG. 2 is a partial perspective view of a slider, provided with an oil return passage in the form of gap fabricated in (a) a vertical slider and (b) a horizontal slider.

Referring to FIG. 2, there is shown in greater detail the slider 421*b* of the displace 31. Provided on the side of the slider 421*b* is a cut that extends along the length of the slider 421*b*. A narrow space or gap defined between the cut and the wall of the slider guide 422*b* provides a passage (hereinafter referred to as oil return gap) 414*b* for the oil to return to the oil sump 413, as shown by a dotted region in FIG. 2*a*. The same is true for an oil return gap 414*a* for the compressor section 20.

It should be noted that such cut on the slider 421*a* is not a hindrance to the salability of the oil seal arrangement. Rather, the cut is recommended for the following reasons. Without the cut, the oil P can stay in the guide space 416*a* and sticks to a main oil seal member 511 described later. This problem could be prevented by the cut since the cut could balance the pressures in the space 416*a* and in the drive chamber 401.

It should be born in mind that in this specification the term "oil seal member" refers not only to an independent sealing member such as ordinary O-ring but also to a sealing portion of a member such as a wall having a passage for the rod with or without a clearance, unless otherwise stated. The same is true for gas seal members. Also, two types of oil seal members will be distinguished by the term "main oil seal members" and by the term "oil seal members", as will be understood shortly.

The stroke of the slider 421*a* is determined so that the oil P on the distal head 423*a* of the slider 421*a* does not come into contact with the separation wall 415*a* of the drive section when the slider 421*a* reaches its left dead point (which is defined as the position of the slider 421*a* having minimum distance from the compression section 20). Alternatively, given the slider stroke, the position of the separation wall 415*a* may be determined so that the oil P on the distal head 423*a* does not touch the separation wall 415*a*. Similarly, the stroke of the slider 421*b*, or the position of the separation wall 415*b*, is determined so that the oil P on the remote head 423*b* of the slider 421*b* does not come into contact with the separation wall 415*b* of the drive section when the slider 421*a* reaches its upper dead point (which is defined as the position of the slider 421*b* having minimum distance from the displace section 30).

Similarly, the position of the slider 421*a* having the maximum distance from the compression section 20 will be referred to as right dead point of the slider 421*a*, and the position of the slider 421*b* having the maximum distance from the displace section 30 will be referred to as the lower dead point of the slider 421*b*.

It should be noted that there will be always non-vanishing spaces (which will be referred to as guide spaces 416*a* and 416*b*) left between the left/upper dead point of the slider 421 and the separator 500.

Since the displace section 30 of the Stirling freezer shown in FIG. 1 is vertical, the oil P accumulating in the guide space 416*b* will return to the oil sump 413 by gravitational force, as indicated by arrows in FIG. 2*a*.

Figure 3:
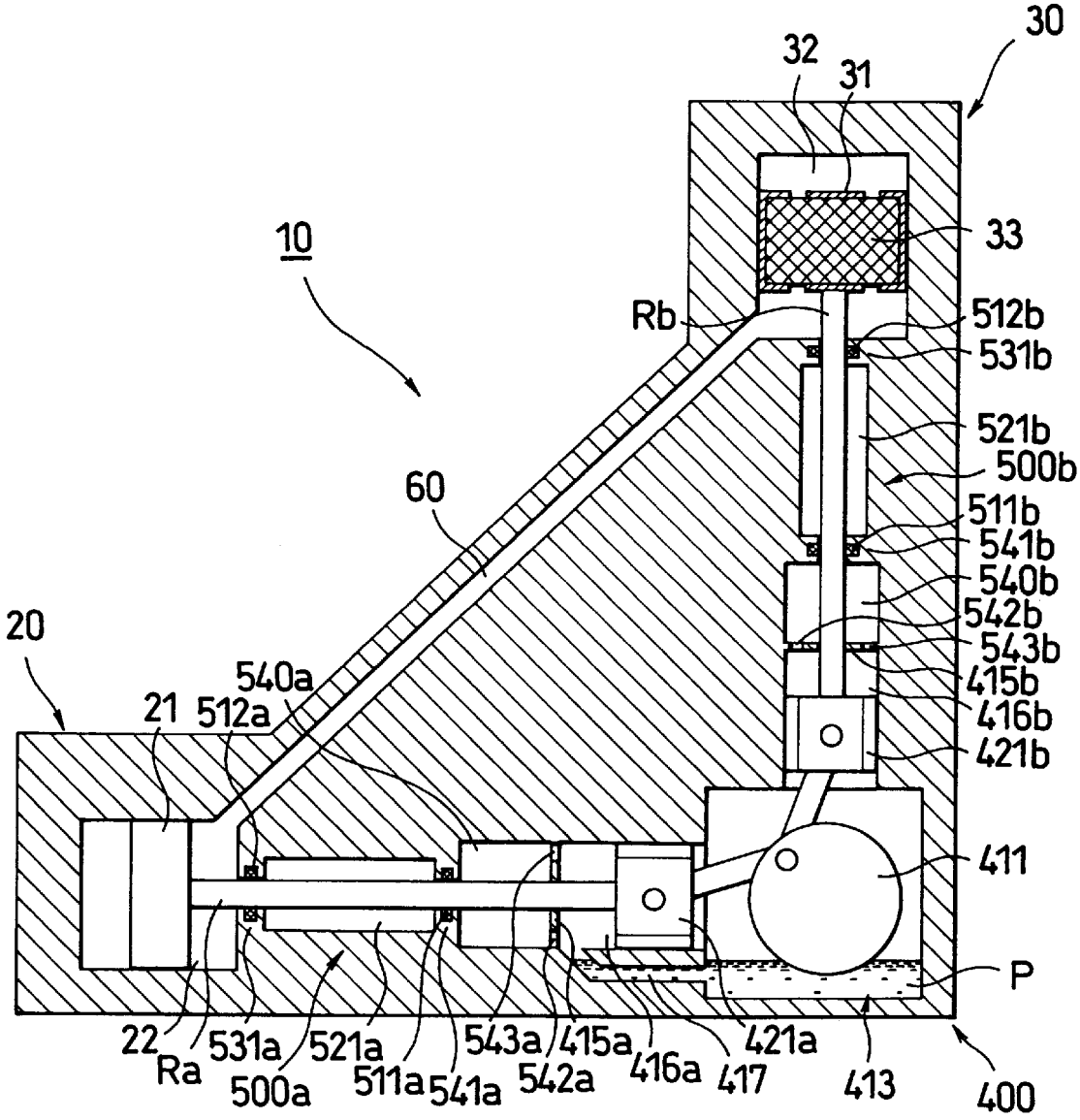
FIG. 3 is a schematic view of a Stirling freezer equipped with a gas compression/expansion apparatus of the invention, the freezer having an improved oil seal arrangement having a front chamber.

However, the oil P in the slider 416*a* of the compressor section 20 cannot spontaneously return to the oil sump 413 only by the gravitational force, since the compressor section is disposed practically horizontally. Thus, an extra oil passage is needed to allow the oil P in the 416*a* to return to the oil sump 413. For this purpose, an oil return passage 417 is provided to communicate between the guide spade 416 *a* and the oil sump 413, as shown in FIG. 3.

As will be understood, the oil return passage 417 is not necessary if the compression section 20 is inclined sufficiently upward as viewed from the drive section 400.

Figure 2B:
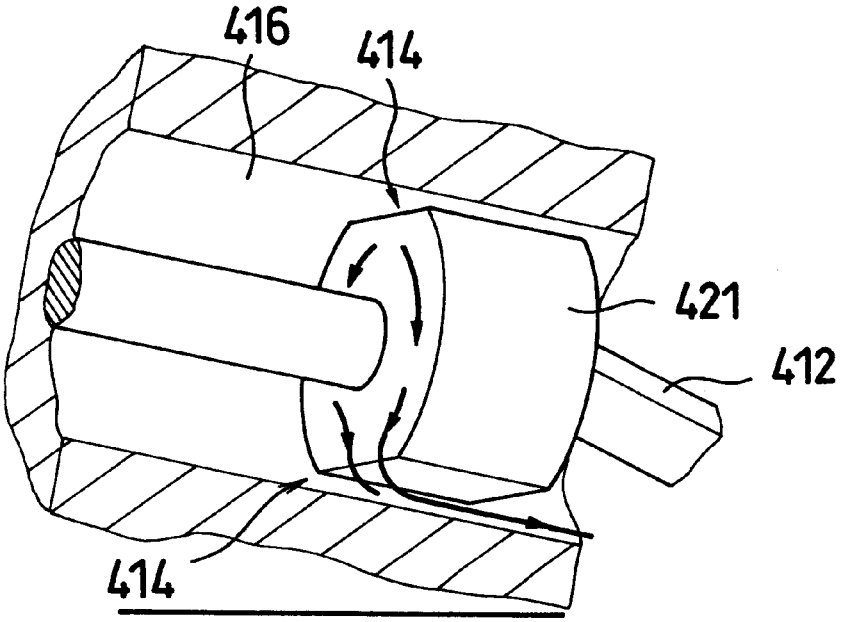

It could be understood that if the compression section 20 or the displace section is inclined upward as viewed from the drive section 400, and so is the slider as shown in FIG. 2*b*, and if at least one oil return gap 414 is provided at the lower side of the slider, the oil passage 417 is not necessary. This is because the gravitational force will then acts on the oil P, urging it to return to the oil sump 413 through the oil return gap.

Alternatively, the oil return gap 414 may be substituted for by an oil return passage 417 if the compression/expansion section is vertical.

It would be apparent that the configuration of the oil return gap 414 is not limited to the one as illustrated in FIG. 2, and that it may be a groove or grooves formed on the side surface of the sliders 421 or alternatively on the slider guide 422.

It would be also apparent that the oil return gap 414 may be substituted for by an axial bore or axial bores formed through the slider 421.

In the example shown in FIG. 1 the compression section 20 is arranged horizontally while the expansion section 30 vertically. Consequently, the thickness of the oil layer P on the head 423*b* of the slider 421*b* is substantially uniform, but the oil layer on the head 423*a* of the slider 421*a* is not uniform. That is, the thickness is larger at the lower end than the upper end of the layer due to gravitation.

Since the thickness of the oil layer is not necessarily uniform, we mean by "thickness of an oil layer" the thickness of an oil layer as measured at the thickest portion thereof. Hence, the thickness of the oil P on the left head 423*a* of the slider 421*a* is defined by the thickness of the oil layer at the lower end of the head 423*a*.

The separator 500 includes: a rod Ra for transmitting the reciprocal motion of the slider 421*a* to the compression piston 21; a rod Rb for transmitting the reciprocal motion of the slider 421*b* to the displace 31; main oil seal members 511 (511*a*, 51*b*) for wiping off the oil P from these rods Ra and Rb; and intermediate chambers 521 (521*a*, 521*b*) for preventing on one hand interference in pressure between the compression space 22 and the drive space 401 and between the expansion space 32 and the drive space 401, and on the other hand for preventing infiltration of oil on the rods R into the compression space 22 and the expansion space 32.

The intermediate chamber 521 is formed inside the separator 500 such that the chamber is separated from the guide space 416 by a separation wall 415 (415*a*, 415*b*) of the drive section as well as from the working section 20/30 by a separation wall 531 (531*a*, 531*b*).

The main oil seal member 511 is provided in the separation wall 415 so that the oil seal member can wipe off the oil on the rods. It should be noted, however, that the oil is not completely removed from the rod by the main oil seal member 511 and remains on the rods in the form of thin layer. The oil seal member 511 may be made of a relatively soft material.

The intermediate chamber 521 is formed such that the distance L2 between the surface of the rod R and the corresponding side wall 522 (522*a*, 522*b*) of the intermediate chamber 521 is greater than T, i.e. L2>T, where T is the thickness of the oil P defined above. In this manner the oil P on the rod R in the intermediate chamber 521 is prevented from entering the working section 20/30 since the oil P is prevented from contacting the side wall 522 of the intermediate chamber 521.

The axial length L1 of the intermediate chambers 521 is longer than the stroke S of the rod R, i.e. L1>S, thereby preventing the tip of the oil P on rod R from contacting a separation wall 531 located at the distal end (as viewed from the drive section 400) of the intermediate chambers 521, where the tip of the oil is defined as the portion of the oil on the rod R and closest to the working section 20/30.

Thus, although the distance between the side wall 523 and the tip of the oil P on the rod R varies periodically with the reciprocal motion of the rod R, it is possible to keep the oil away from the side wall 523 and maintain the side wall 523 free of oil. This helps to prevent the oil from entering the working section 20/30.

It would be understood that the length L1 and L2 are appropriately chosen for optimum operation of the compression/expansion apparatus by taking into account relative positions of the compression section 20 and the expansion section 30, strokes of the compression piston 21 and displace 31, diameters as well as material properties of the rods R, and salability of the main oil seal members 511.

For example, in the Stirling freezer 10 as shown in FIG. 1 the compression section 20 is virtually horizontal. As a result the oil P on the rod Ra in the intermediate chamber 521*a* tends to flow in the direction perpendicular to the rod axis due to gravitation. In general, the thickness T of the oil P on the rod R depends on the inclination of the intermediate chambers 521*a* and 521*b* under the influence of gravitation.

The amount of oil P that remains on the rod R in the intermediate chamber 521 varies with the effective area, and hence the diameter R and the stroke S of the rod in the intermediate chamber 521. In operation the crank mechanism 411 of the Stirling freezer 10 is actuated by a motor (not shown), which mechanism in turn operates the compression piston 21 and the displace 31.

Referring to FIG. 1, the operation of the Stirling freezer 10 will be now described.

In a process where the compression piston 21 moves from the left dead point to the right dead point, the working gas in the compression space 22 is compressed isothermally by the compression piston 21. The compressed working gas is delivered from the compression section 20 to the displace section 30 through the gas passage 60.

During this process the displace 31 is moved upward to its upper dead point, compressing the gas therein, and then moved down to the lower dead point. As the displace 31 goes down, the working gas is passed to the expansion space 32 through the heat capacitor 33, liberating heal thereto.

As the displace 31 reaches the lower dead point, the compression piston 21 moves from the right dead point to the left dead point, causing the working gas to undergo isothermal expansion by absorbing heat from an ambient medium, thereby cooling the medium.

As the compression piston 21 approaches the left dead point, the displace 31 begins another upward motion, so that the working gas in the expansion space 32 is passed through the displace 31, absorbing heat from the heat capacitor 33. This completes the cycle.

It would be noted that, should oil P enter the working section 20/30 during the cycle, the refrigeration power of the Stirling freezer 10 is lowered.

Such infiltration of oil becomes significant if the oil P on the leading head (distal end) 423 of the slider 421 comes into contact with the separation wall 415, because then the oil P transferred from the head 423 onto the main oil seal member 511 is forced by the slider into the main oil seal member 511.

On account of the reciprocal motion of the rod R, the oil once trapped in the main oil seal member 511 promptly tends to infiltrate into the working section 20/30.

Advantageously, such infiltration of oil can be cut by making the axial dimension of the guide space 416 larger by a length that is larger than the thickness T of the oil P sticking on the leading head 423 of the slider.

It may happen that during reciprocal motions of the slider 421 an oil droplet is released from the head 423 of the slider 421 on the main oil seal member 511 by an inertial force acting on the droplet.

The amount of the oil P deposited on the main oil seal member 511 in this manner can be minimized by making the dimension of the guide space 416 appropriately large so that the oil droplet can drop in the guide space 416 before it reaches the main oil seal member 511.

Also, if oil P accumulates in the guide space 416, it may be scattered by the moving slider 421 onto the main oil seal member 511.

In order to remove the oil accumulation in the guide space 416, the guide space 416 is communicated with the oil sump 413 by the oil return passage 417, as previously described. For the same purpose, the slider 421 may be provided with an oil return gap 414.

Thus, thanks to the guide space 416 along with the oil return passage 417 and gap 414, the main oil seal member 511 is protected from superfluous oil. Hence the main oil seal member 511 need not be tight on the rod R and may have a predetermined finite clearance for the rod R. The main oil seal member 511 having such finite clearance may maintain its salability if the clearance has become larger due to wear.

The oil seal arrangement of the invention thus prevents the infiltration of oil caused by capillary effect which is prompted by the reciprocal motion of the rod, and extends life of the Stirling freezer.

It would be noted that, although the pressure in the working space 22/32 varies periodically with the reciprocal motions of the compression piston 21 and the heat capacitor 33, the pressure will not vary significantly in the drive space 401. Consequently, there will be a periodic pressure gradient generated across the main oil seal member 511, and as the pressure becomes higher in the drive chamber 401 than in the guide space 416, the oil staying on the main oil seal member 511 tends to flow into the working space 22/32 due to the pressure gradients.

It would be appreciated that without the intermediate chamber 521 the pressure at the distal end of the main oil seal member 511 (the end closer to the working space 22/32) will pulsate in the same way as in the working space 22/32 since then the working space 22/32 would directly communicate with the intermediate chamber 521 through passages provided between the separation wall 531 of the intermediate chamber 521 and the rod R. In this case when the pressure is lower in the working space 22/32 than in the drive space 401, the oil tends to flow into the working space 22/32.

In order to minimize such pressure gradient, the invention provides an intermediate chamber 521 in the separator 500 between the drive space 401 and the working space 22/32 so that a major portion of the rod R is accommodated in the intermediate chambers 521.

In relieving the pressure gradient across the intermediate chamber 521, a tight gas seal member 512 (512*a*, 512*b*) may be advantageously provided in the separation wall 531, as shown in FIG. 3. The gas seal member 512 may be easily fitted in the wall 531. It should be noted that the combination of the tight gas seal member and the intermediate chamber contributes to effective suppression of oil infiltration into the working spaces 22/23.

In cases where the oil infiltration is suppressed by the intermediate chamber 521, main oil seal member 511, and the gas seal member 512, the axial length L1 of the intermediate chamber 521 need not be larger than the stroke S of the rod R. That is, the length L1 may be chosen such that $L1 \leqq S$, since in this case the flow of oil into the compression/expansion space 22/32 will be substantially cut down and the proportion of the oil mixed in the working gas will be virtually negligible. This is true especially when the oil has a law vapor pressure.

It should be appreciated that even under the tight gas seal is secured by the gas seal member 512, a thin layer of the oil P remains on the rod, so that the friction between the tight gas seal member 512 and the rod R is properly reduced, thereby protecting the gas seal member 512 from wear.

In often cases, the amount of oil P deposited on the slider 421 depends on several design parameters, for example the size of the intermediate chamber. Also, the amount of oil depends on the operating conditions of the freezer. For example, when the freezer is installed on a slope, a greater amount of the oil P in the guide space can vary. One way to make the oil seal arrangement not susceptible to these varied conditions is to provide a guide space 416 having a large diameter, which is, however, not recommended, since it would render the entire dimension of the freezer very large. Thus, it is desirable to provide alternative means for dealing with this problem.

In order to further prevent the infiltration of oil into the main oil seal member 511, a front chamber 540 (540*a*, 540*b*) is provided adjacent to the intermediate chamber 521. The front chamber 540 has an inner radius sufficiently greater than that of the rod R so that, as in the intermediate chamber 521, the oil P on the rod do not touch the surface of the front chamber, as shown in FIG. 3. Proved in a separation wall 541 between the front chamber and the intermediate chamber 521 is a main oil seal member 511. In this case the separation wall 415 may have a predetermined clearance for the rod R so that the separation wall 415 serves as a non-tight oil seal member. Then most of the oil once deposited on the rod R is removed first by the separation wall 415, leaving a substantially constant amount of oil P on the main oil seal member 511 irrespective of other design parameters and operating conditions as mentioned previously. Therefore, the compression/expansion apparatus may be designed assuming that the amount of oil P that remains in the main oil seal 511 is constant.

Under such condition, however, oil P will accumulate in the front chambers 540 and it must be returned to the oil sump 413.

To do this the separation wall 415 is provided with an oil return hole 542 (542*a*, 542*b*) and air hole 543 (543*a*, 543*b*) which may keep the pressure in the front chamber 540 and the drive section 400 balanced.

It is often the case that provision of the partition wall 415 having a precise predetermined clearance is difficult due to the fact that high precision machining of the rod R and the partition wall 415 is not easy. In addition, setting up a desired clearance is difficult, especially if the rod R is deformable.

The magnitude of the clearance for the rod in the separation wall 415 is a matter of compromise between a practical choice of the precision and other parameters such as the size of the oil return hole 542 which controls the amount of oil returned from the front chamber 540 to the oil sump 413. For example, if the clearance is increased, then the amount of the oil that accumulates in the front chamber 540 is accordingly increased, so that the size of the oil return passage must be determined to meet the requirement that the oil do not exceed a predetermined level in the front chamber 540. Optimum size of the clearance also depends on the operating speed of the freezer in that oil P increases periodically in the front chamber 540 due to periodicity of the compression/expansion apparatus, and the clearance must be such that it prevents excessive oil accumulation in the intermediate chamber 521. Otherwise, the main oil seal member 511 will be eventually stained excessively by the oil. Thus, it is generally desirable to make the clearance as small as possible.

Figure 4:
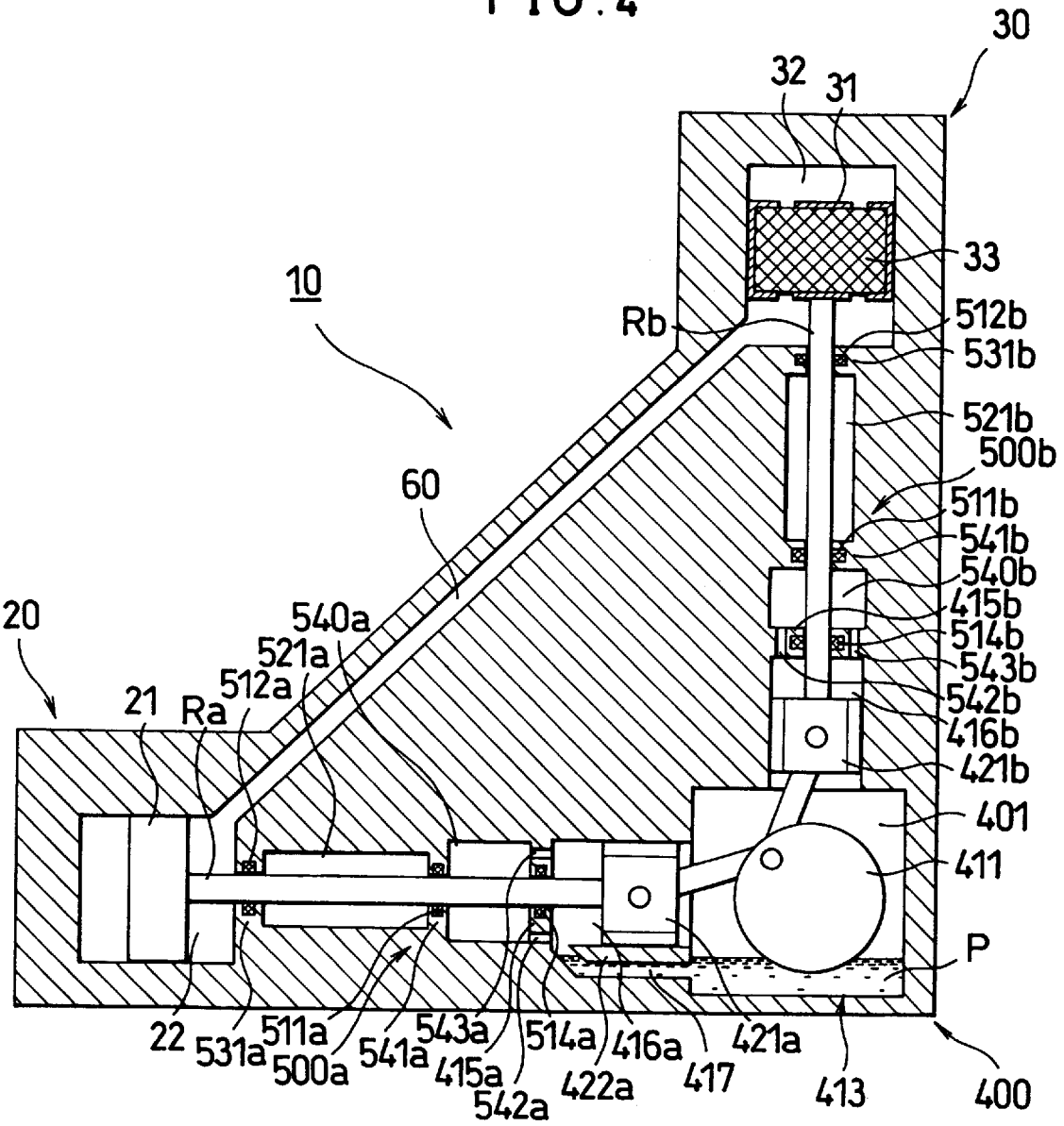
FIG. 4 is a schematic view of a Stirling freezer equipped with a gas compression/expansion apparatus of the invention, the freezer having an improved oil seal arrangement having an oil seal member in a wall of the separator partitioning the drive section.

A sufficiently small clearance for the rod in the separation wall 415 may be provided by an oil seal member 514 as shown in FIG. 4. It is relatively easy to manufacture this type of seal member. When the oil seal member 514 is provided together with the main oil seal member 511 and the intermediate chamber 521, the oil seal member 514 can be a non-tight seal member.

If instead the separation wall 415 is not provided with the oil seal member 514, the wall 415 can be made very thin and it is not difficult to provide a sufficiently tight hole for the rod R. If the separation wall 415 is initially tight on the rod, the thin wall 415 will not give the rod excessive friction and will eventually wear, resulting in an appropriate clearance for the rod.

Figure 5:
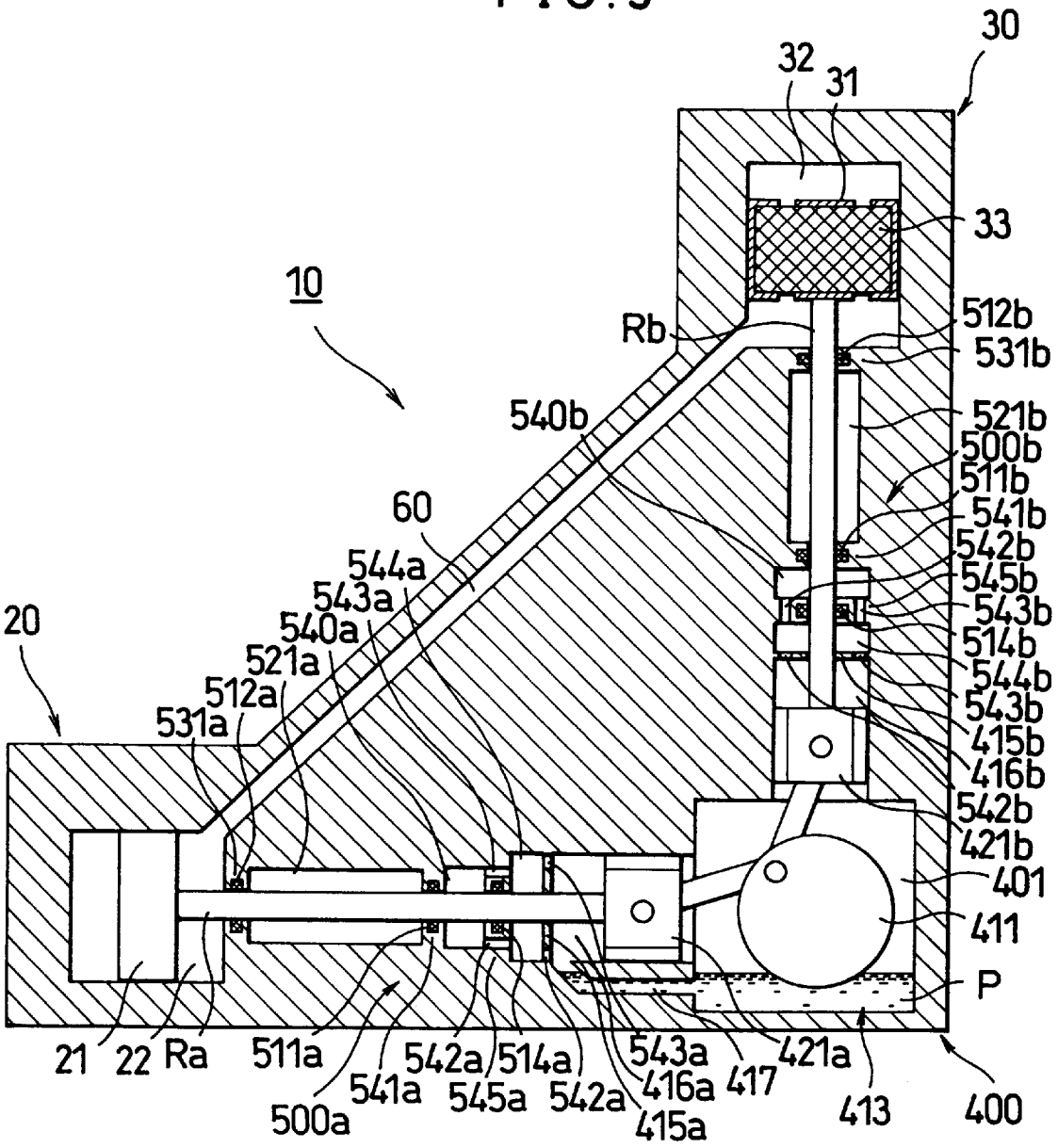
FIG. 5 is a schematic view of a Stirling freezer equipped with a gas compression/expansion apparatus of the invention, the freezer having an improved oil seal arrangement having a multiplicity of front chambers.

It would be apparent that more than one front chamber 540 may be provided. FIG. 5 shows an example in which a front chamber 540 is provided in the separator wall 500 between the intermediate chamber 521 and the drive section 400, and additional front chamber called auxiliary front chamber 544 between the front chamber 540 and the drive section 400. FIG. 5 shows an example in which, in addition to the front chamber 540 formed in the separator wall 500 adjacent to the intermediate chamber 521, another front chamber, called auxiliary front chamber 544, is provided between the front chamber 540 and the slider guide 422. The front chamber 540 is separated from the intermediate chamber 521 by the separation wall 541; the auxiliary front chamber 544 is separated from the front chamber 540 and the slider guide by a separation wall 545 and the separation walls 415, respectively.

As seen in the figure, the rod R penetrates: the gas seal member 512 in the separation wall 531 between working space 22/32 and the intermediate chamber 521; the main oil seal member 511 in the separation wall 541 between the intermediate chamber 521 and the front chamber 540; the oil seal member 514 in the separation wall 545 between the front chamber 540 and the auxiliary front chamber 544; and the separation wall 415. It should be noted that the separation wall 415 has no oil seal member, but acts itself as an oil seal member.

In the example shown above, the separation wall 545 for the front chamber 540 and the separation wall 415 are each provided with the oil return hole 542 and the air hole 543. The oil return hole 542 can be formed so that the oil P may flow through it back to the oil sump 413 under gravitational force.

It would be appreciated that the auxiliary front chamber 544 having the separation wall 415 enables elimination of most of the oil P that would otherwise enter the front chambers 540 through the separation wall 545, and that the amount of the oil P in the front chambers 540 is suppressed at a substantially constant level. Hence, the main oil seal member 511 and the intermediate chamber 521 may be designed based on the assumption that the oil P in the front chambers 540 remains constant independently of other design parameters and operating conditions mentioned previously.

It should be noted that, if both the clearance between the rod R and the oil seal member 514 in the separation wall 545 between the front chamber 540 and the auxiliary front chamber 544 as well as the clearance for the rod R in the separation wall 415 are large, the pressure in the auxiliary front chamber 544 and the front chambers 540 will be balanced with the pressure in the drive section 400, so that the air holes 543 are not needed, provided that the clearances are not completely filled by the oil P sticking on the rod.

Also, when the clearances are arranged such that when the oil P deposited on the separation wall 545 flows down on the rod due to gravitation, it fills only the lower portion of the clearances and upper portion of the clearances can be open to the air, thereby balancing the pressures of the air across rod. In this case the air hole 543 is not needed either.

In the vertical front chamber 540*b* of the displace section 30, the oil P can accumulate at the bottom of the front chamber 540*b*, which can clog the air hole 543*b* and choke the front chambers 540*b*, thereby stopping the oil P to return to the oil sump 413 and causing the oil P to further accumulate in the front chambers 540*b*.

Figure 6A:
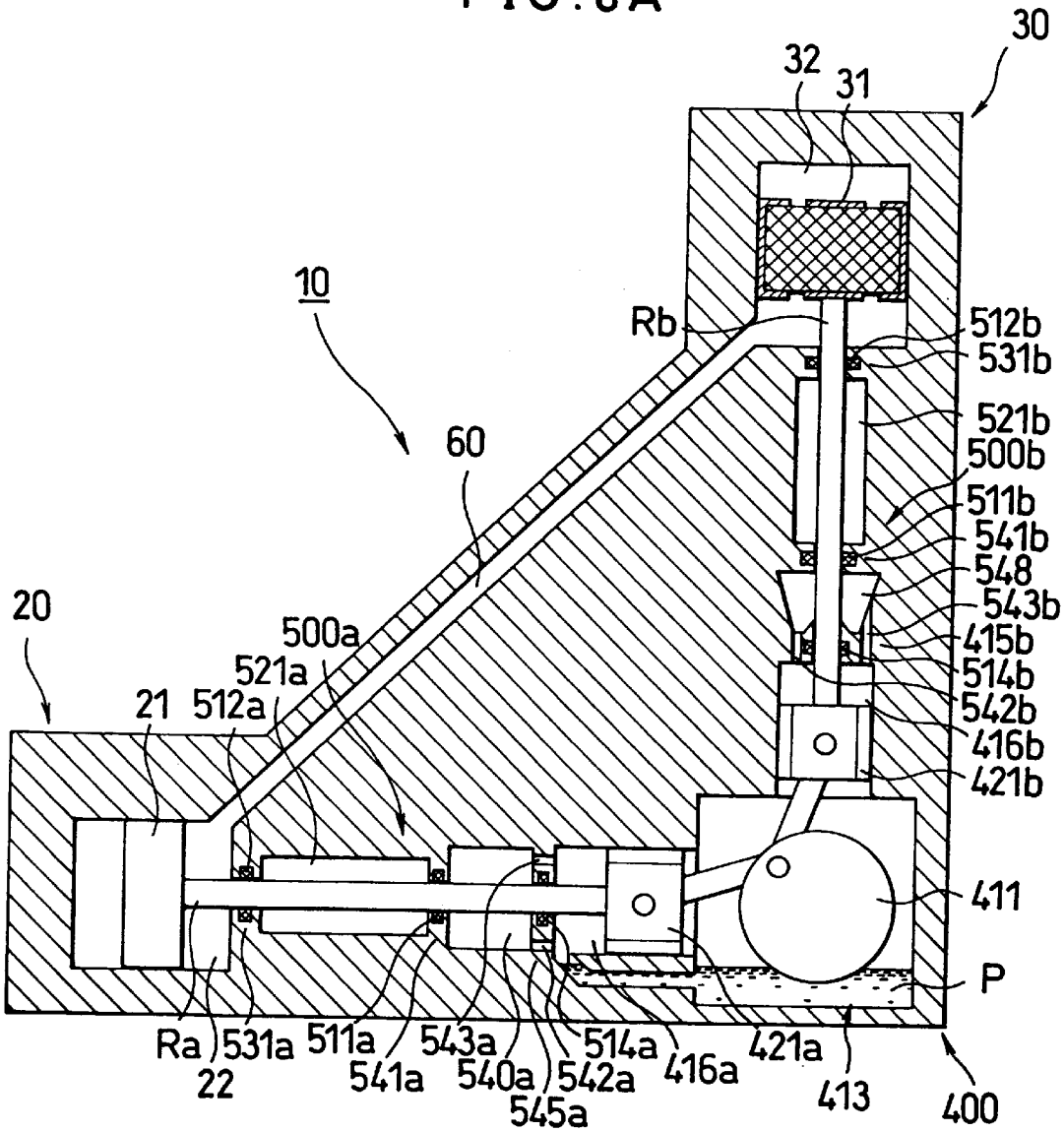
FIG. 6(*a*) is a schematic view of a Stirling freezer equipped with a gas compression/expansion apparatus of the invention, the apparatus having a vertical front chamber.
Figure 6B:
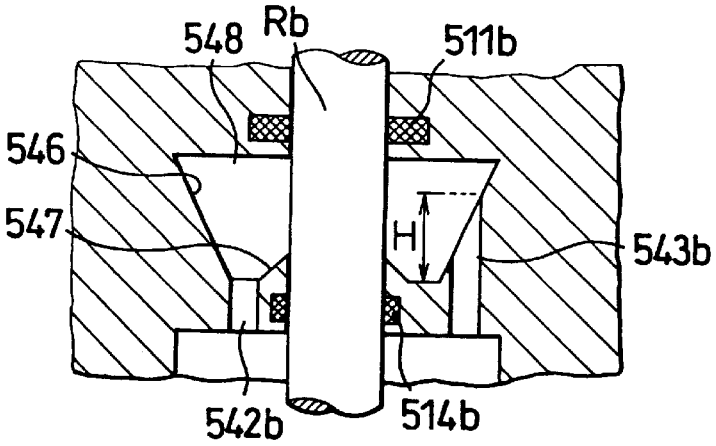

This problem can be solved by arranging the air hole 543*b* of the front chamber 540*b* higher than the oil return passage, as shown generally in FIG. 6*a* and in greater detail in FIG. 6*b*.

To facilitate the oil P in the front chamber 548 to flow into the oil return hole 542*b* under gravitation, the side wall 546 of the front chamber 548 may be inclined towards the oil return hole 542*b*. In addition, a portion of the bottom surface 547 of the front chamber 548 may be raised sharply to the rod R so that the oil P on the rod R is scraped into the oil return hole 542*b*.

It would be noted that, if the surface of the main oil seal members 511 has at the end thereof facing the intermediate chambers 521a configuration that tends to scrape the oil on the rod R, the oil scraped from the rod will accumulate at the bottom of the intermediate chamber 521, which is not preferable.

Although the sealing face of the main oil seal members 511 is normally designed to be parallel with the rod R, it is actually difficult to provide the main oil seal member 511 with such parallel sealing face unless the main seal member 511 is urged to abut on the rod R for tight seal.

Figure 7:
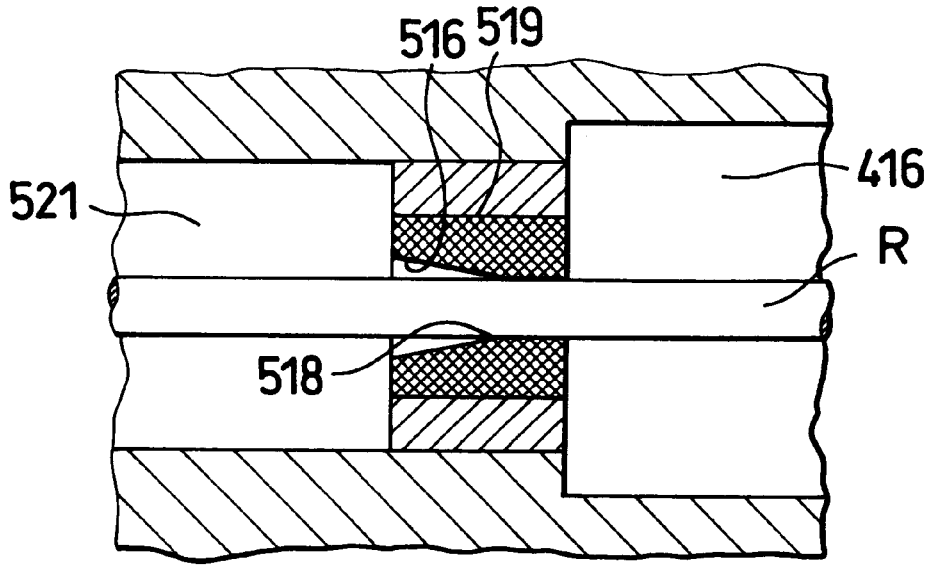
FIG. 7 is a sectional view of a tapered oil seal member for the oil seal arrangement.

A solution to this problem is to provide a main oil seal member with a slightly tapered sealing face, as shown in FIG. 7. If the sealing face of the main oil seal member 519 is tapered towards the working space 22/32, the oil on the rod R tends to accumulate, by capillary effect, at the bottom 518 of a conic region between the rod R and the tapered surface 516. When the rod R moves away from the working space 22/32, it drags the oil P trapped on rod R to the bottom, thereby increasing the pressure in the oil P>. This helps the oil P to return to the drive section.

Such technique of tapering the sealing face unnecessitates fabrication of a parallel sealing face of the of the main oil seal member. Furthermore, such tapering may not only suppress the oil P in the working section 20/30, but also eliminate unexpected inverted tapering of the sealing faces. In addition, should the tapered face wear, the bottom 518 of the tapered face of the main oil seal member 519 would merely shift towards the drive section 400 without loosing its salability.

Figure 8:
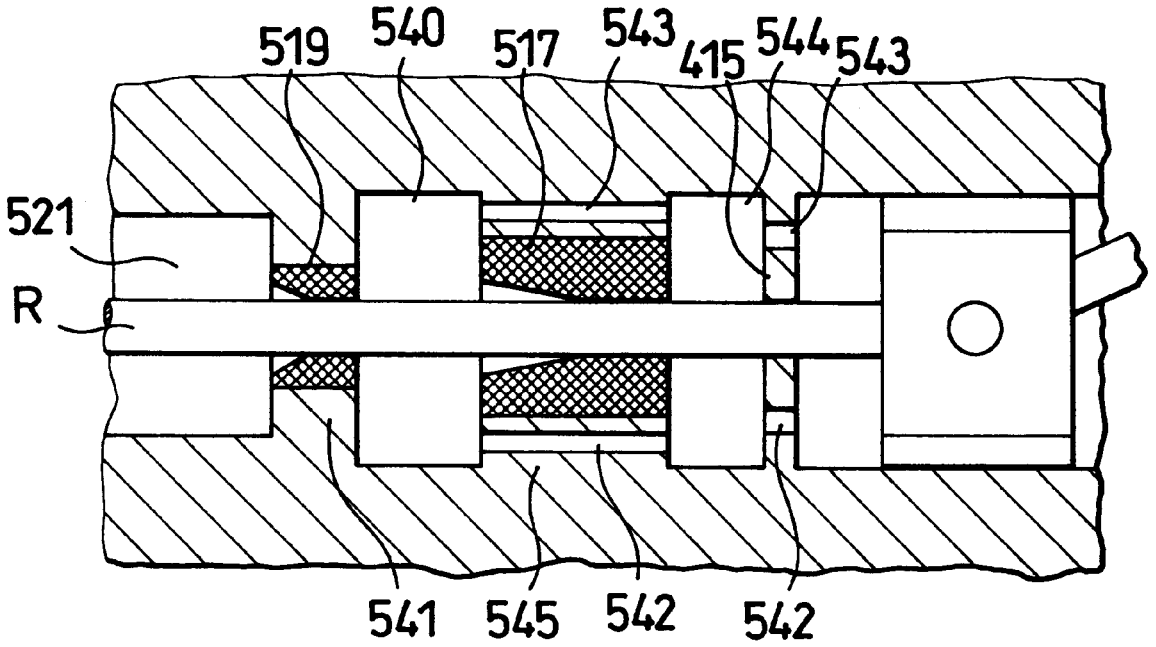
FIG. 8 is a major portion of a tapered oil seal member installed in a gas compression/expansion apparatus of the invention for a Stirling freezer.

When a multiplicity of front chambers 540 are provided, each of the front chambers may be provided with such tapered seal member. FIG. 8 shows an example of a multiple tapered oil seal members, with one tapered oil seal member 519 installed in an intermediate chamber 541 and another tapered oil seal member 517 in a separation wall 541 of a front chamber.

It would be recalled that the major source of the oil infiltration into the working section 20/30 is the pressure variations in the working section which makes the pressure in the intermediate chamber 521 temporarily higher than the pressure in the drive section 400.

It is possible to minimize the influence of such pressure variations in the working space 22/32 to the intermediate chambers 521 by the use of a tight gas seal member as the seal member 512 so as to increase the fluid resistance (defined as drag or friction of a gas through a passage) through the gas seal member. However, such tight gas seal member requires not only additional drive power for the rod but also causes quick wear of the gas seal members 512. Therefore, it is advantageous to employ an alternative means for permitting a realistic clearance in the gas seal member.

Figure 9:
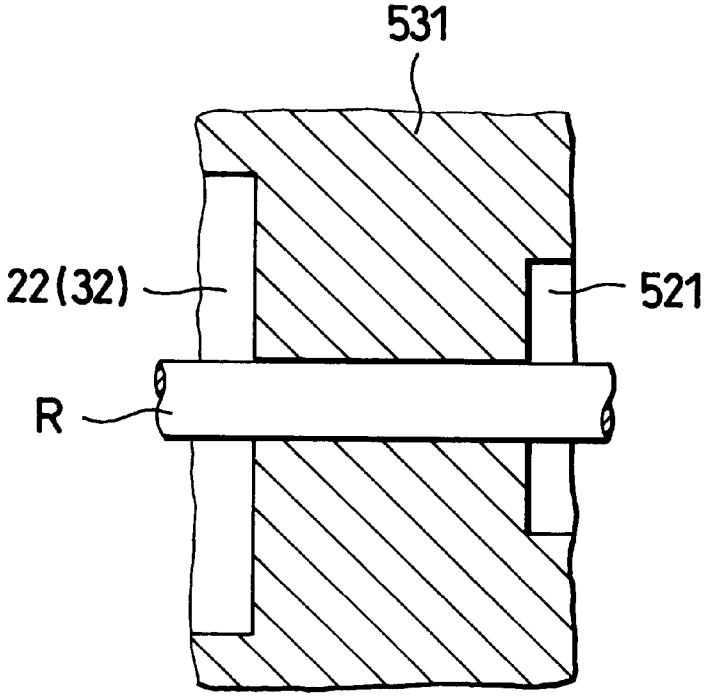
FIG. 9 is a sectional view of a gas seal member having an extended sealing face.

From this point of view, it is advantageous to provide a thick separator wall 531 having an extended fluid passage along the rod passing through it, so that the fluid passage exhibits large fluid resistance, as shown in FIG. 9. If the fluid resistance through the extended passage is made sufficiently large, the separation wall 531 need not be a tight seal, yet it may serve as a good gas seal member.

Figure 10:
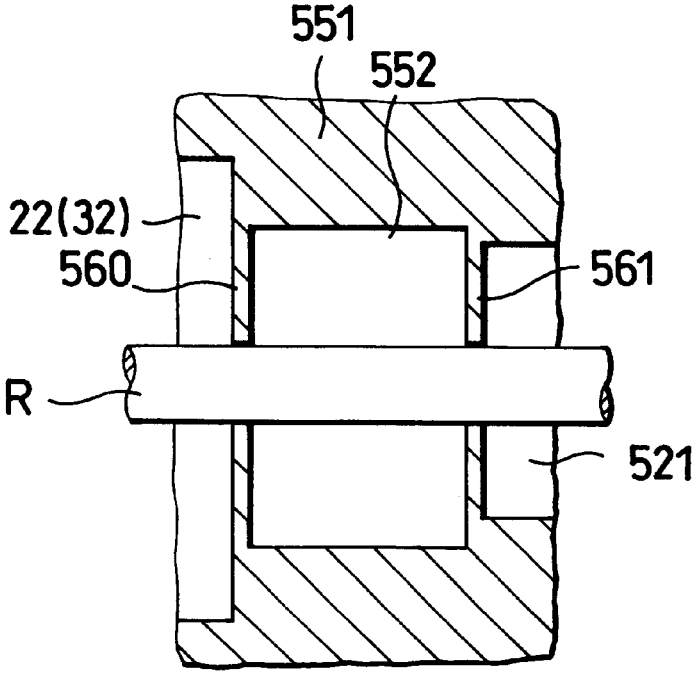
FIG. 10 is a sectional view of a gas seal member having a void inside thereof.

As a means for providing optimum fluid resistance of the air, a void 552 may be formed in the gas passage as shown in FIG. 10. The void 552 is defined between the working section 20/30 and the intermediate chamber 521 by the separation walls 560 and 561. The separation walls 560 and 561 have clearances for the rod R and constitute non-contacting gas seal members 551.

The gas seal member 551 may relieve pressure variations in the intermediate chambers 521, thereby preventing the flow of oil into the working space 22/32 caused by the pressure change in the intermediate chambers 521.

Figure 11:
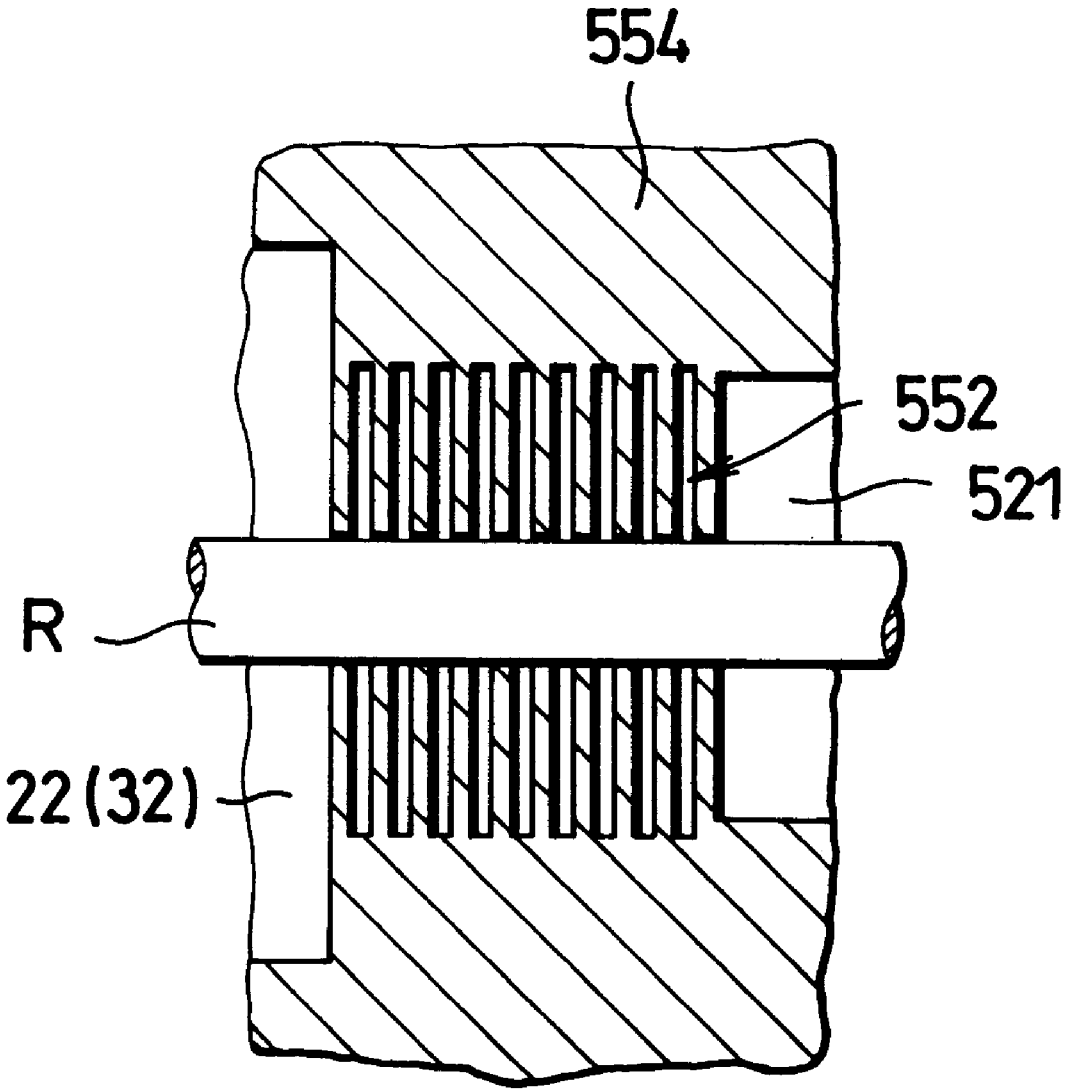
FIG. 11 is a sectional view of a gas seal member having a multiplicity of voids inside thereof.

It would be understood that the number of such voids 552 formed in the gas seal member 551 is arbitrary, since any number of such voids may absorb the pressure variations taking place in the intermediate chamber 521 and may diminish the pressure gradient across the main oil seal member. In fact a multiplicity of voids 552 may be used to form a non-contacting gas seal member as shown in FIG. 11. This type of seal member is called labyrinth seal.

In the labyrinth seal member only small pressure difference exists between the two neighboring voids, so that it may effectively destruct the pressure differences across the main oil seal member.

Figure 12:
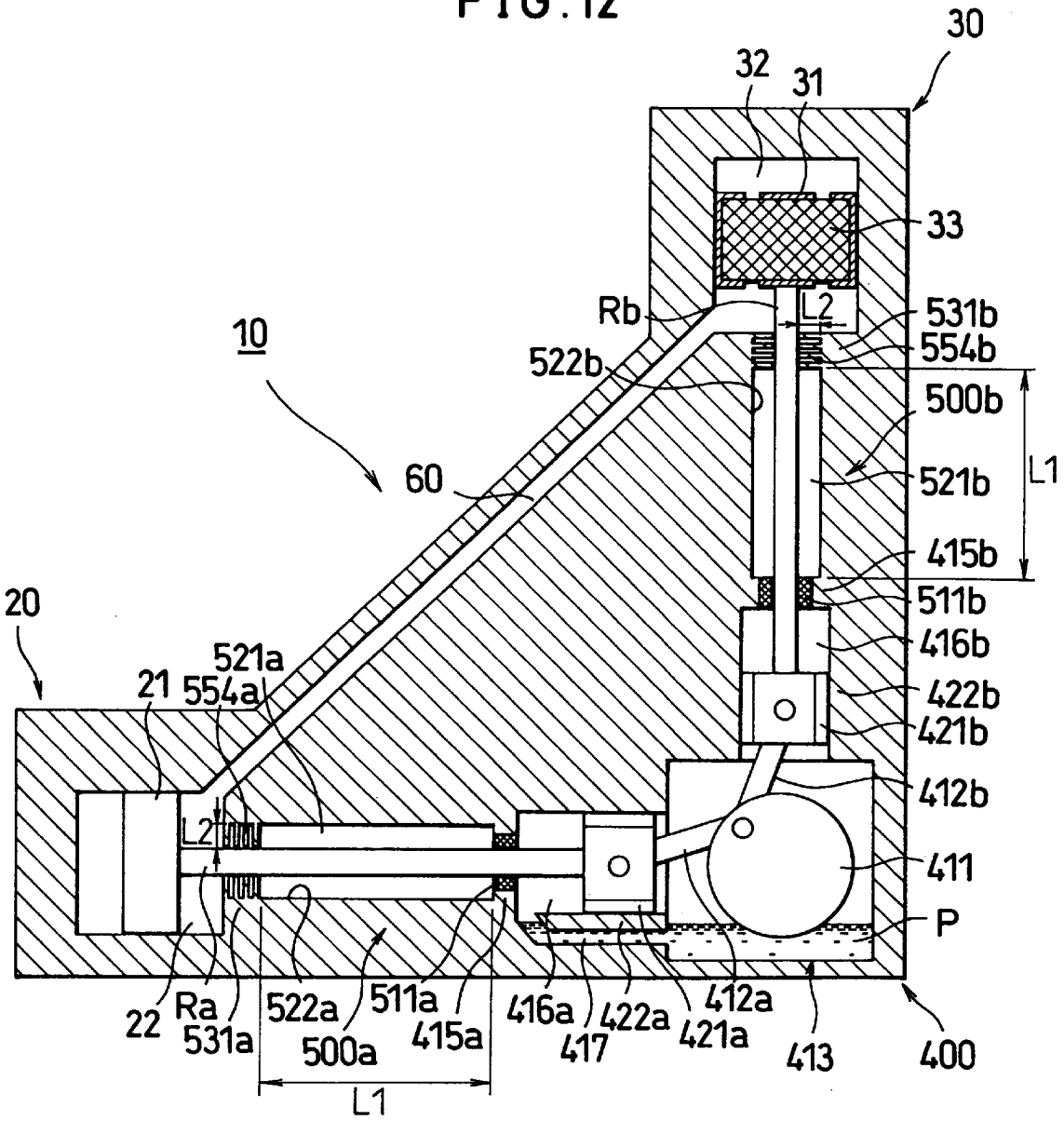
FIG. 12 is a schematic view of a Stirling freezer equipped with a gas compression/expansion apparatus having an oil seal arrangement that includes a multiplicity of voids in its gas seal member.

Referring to FIG. 12, there is shown another Stirling freezer equipped with labyrinth seal members in the separation walls between the working section 20/30 and the intermediate chambers 521.

Figure 13:
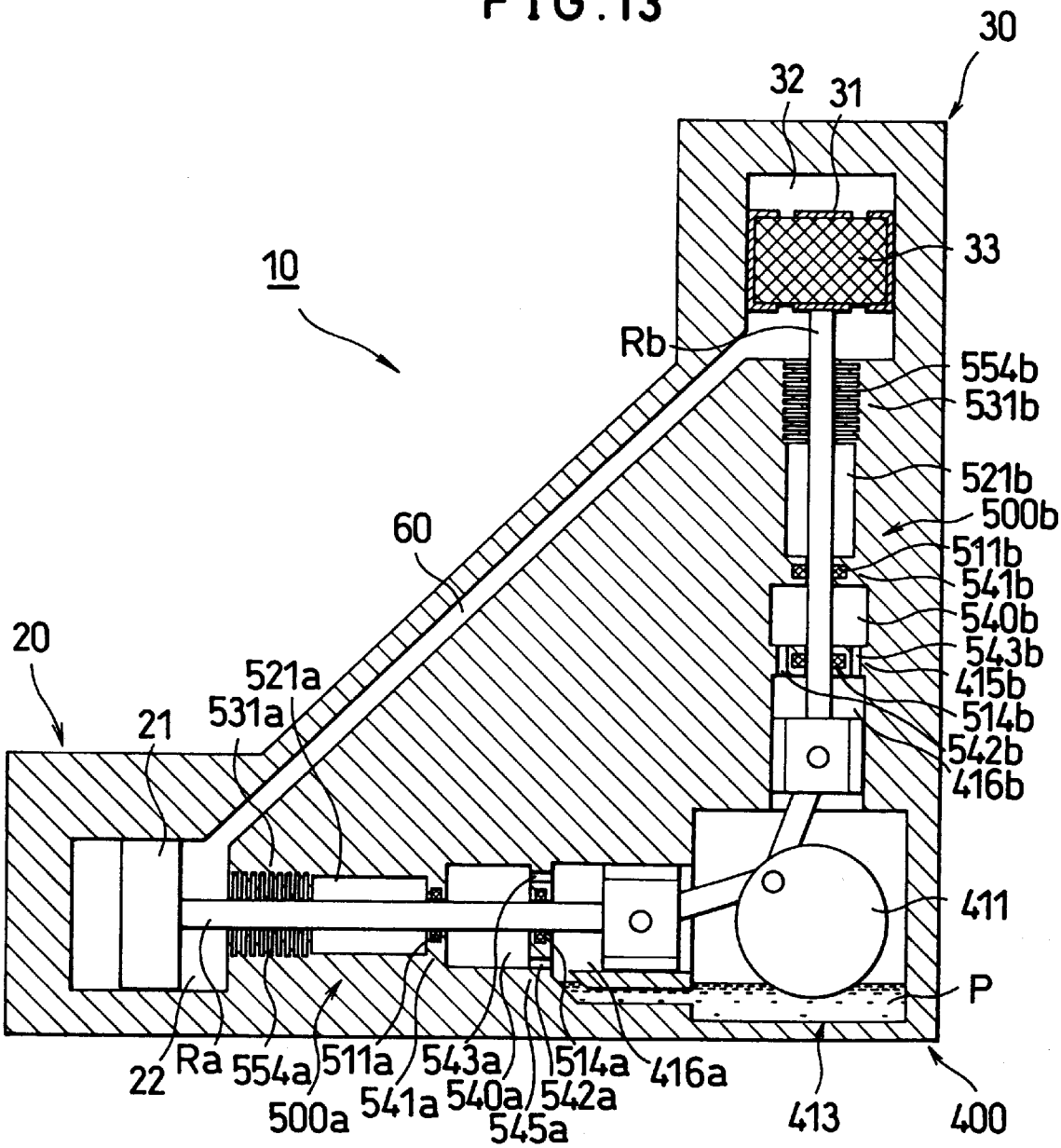
FIG. 13 is a schematic view of a Stirling freezer equipped the gas compression/expansion apparatus having an oil seal arrangement of FIG. 12, further including a front chamber in the oil seal arrangement.
Figure 14:
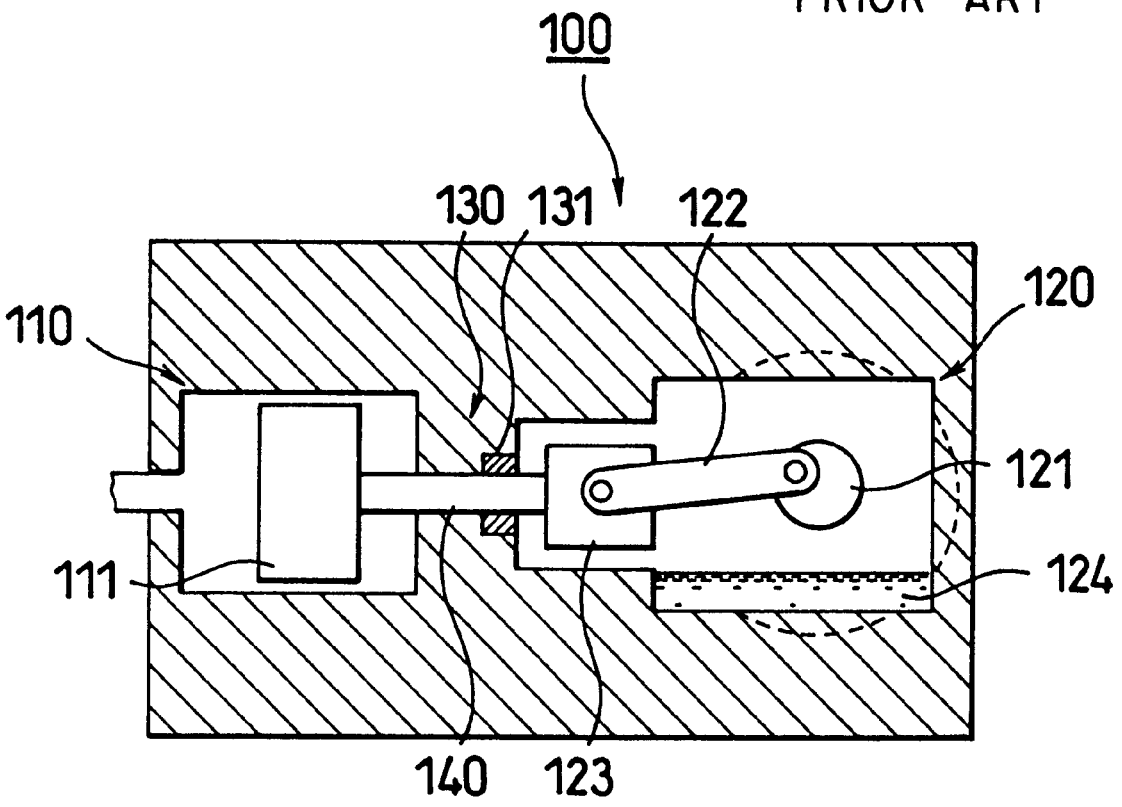
FIG.14 PRIOR ART
FIG. 14 is a schematic view of a conventional gas compression/expansion apparatus.
Figure 15:
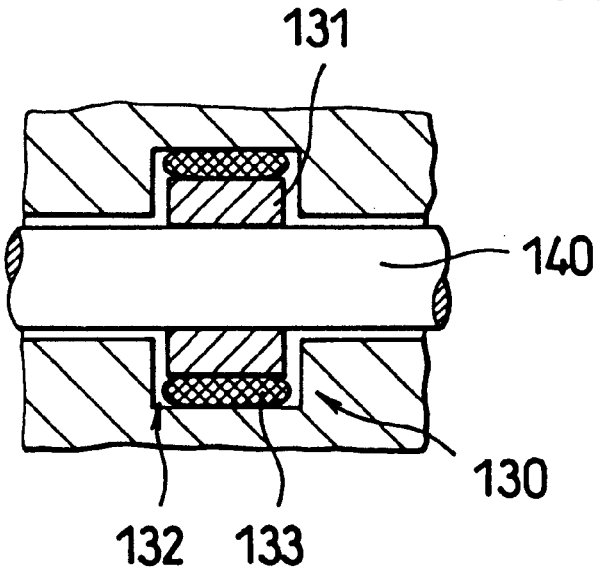
FIG.15 PRIOR ART
FIG. 15 is a figure for use in describing the function of an oil seal arrangement.

Referring to FIG. 13, there is shown a still another Stirling freezer which is basically the same as one shown in FIG. 12, but further equipped with the front chambers described above for convenience and economy in preventing infiltration of oil into working section 20/30.

Results of the running tests done for a test model of Stirling freezer 10 embodying the invention will now be described. The tests ranged from 3000 to 6000 hours. It is found from the tests that in order to obtain the result of the invention the axial dimension of a guide space along the rod be equal to or larger than 1.5 mm, the axial length of the intermediate chamber L1 be larger than the stroke L of the rod plus 3 mm, the distance L2 between the surface of the rod R in the intermediate chamber and the wall of the chamber be larger than 0.5 mm.

It was also found from the tests that the main oil seal member 511 provides good sealing without the intermediate chamber 521 if only the guide space 416 is provided.

No oil was found staying in the guide space 416 when oil seal members having oil return passages 417 and the voids 552 and oil return gaps 414 are employed.

An actual manufacture model of Stirling freezer is more limited in dimension than the test model. In the actual manufacture model the intermediate chamber 521 and the guide space 416 cannot have arbitrary dimensions. Tests reveals that desirable dimensions for the actual model are as follows:

Axial length of the slider in the range of 5 to 10 mm;

Axial length L1 of the intermediate chamber rod stroke S+(3 to 10) mm;

Distance between the rod surface in the intermediate chamber and the wall of the intermediate chamber 10 to 30 mm.

Tests were also made for 3000–6000 hours for a test model of Stirling freezer having front chambers 540 in addition to the intermediate chambers 521. The tests reveals that desirable dimensions are:

Axial length L1 of the intermediate chamber rod stroke S+(3 to 20) mm

Axial length of the front chamber not less than 5 mm

It should be understood that these values may depend on the types of the apparatuses.

Although the presently preferred embodiment of the invention has been described, it is not intended to limit the invention to the particular form disclosed, but on the contrary, the intention is to cover all modifications, equivalents, and alternatives falling within the spirit and scope of the invention as defined by the appended claims.

What is claimed is:

1. A compression/expansion apparatus, comprising:

first and second working sections accommodating first and second reciprocal pistons, respectively, connected with first and second rods, respectively;

a drive section having an oil sump and a drive for said first and second pistons through first and second sliders, respectively, which are connected with the first and second rods, respectively, and guided by first and second slider guides, respectively, for undergoing reciprocal motions;

a separator for separating said working sections from said drive, said separator having penetrating rod holes for receiving therein said reciprocal rods;

a guide space formed in each of said slider guide such that, during said reciprocal motion of the rod, the minimum distance between said slider and said separator is larger than the thickness of the oil layer deposited on said slider so that said oil is prevented from directly touching said rod holes; and an oil return passage in each of said slider guide for allowing the oil accumulating in said guide space to return to said oil sump.

2. A compression/expansion apparatus, comprising:

first and second working sections accommodating first and second reciprocal pistons, respectively, connected with first and second rods, respectively;

a drive section having an oil sump and a drive for said first and second pistons through first and second sliders, respectively, which are connected with the first and second rods, respectively, and guided by first and second slider guides, respectively, for undergoing motions;

a separator for separating said working sections from said drive, said separator having penetrating rod holes for receiving therein said reciprocal rods;

intermediate chambers each formed in said separator for accommodating the rod associated with one of said pistons, said intermediate chamber having inner radius larger than the radius of the rod plus the thickness of oil on the rod;

working section separators for separating said working sections from said intermediate chambers; and drive section separators for separating said intermediate chambers from said drive section.

3. The compression/expansion apparatus as claimed in claim 2, further comprising:

at least one front chamber formed between said intermediate chamber and said drive section separator so as to accommodate the rod associated with said piston, and having an inner radius larger than the radius of the rod plus the thickness of oil on the rod;

an oil return hole for allowing oil accumulated in said front chamber to said oil sump;

an air hole for communicating said front chamber with said drive section;

an intermediate chamber separator for separating said intermediate chamber from said front chamber; and a front chamber separator for separating neighboring front chambers when multiple front chambers are provided associated with said piston.

4. The compression/expansion apparatus as claimed in any one of claims 1–3, wherein said slider has at least one cut formed along the length of said slider; and said oil return passage is a gap formed between said slider guide and said cut on said slider.

5. The compression/expansion apparatus as claimed in any one of claims 1–3, wherein at least one of said slider and said slider guide has a groove facing the other; and said oil return passage is a longitudinal gap across said slider, defined by said groove and the other of said slider and said slider guide.

6. The compression/expansion apparatus as claimed in any one of claims 1–3, wherein said oil return passage is formed through said slider.

7. The compression/expansion apparatus as claimed in any one of claims 1–3, wherein said oil return passage is formed through said slider guide to communicate between said guide space and said oil sump.

8. The compression/expansion apparatus as in claim 5 the preceding claims, wherein said oil return passage is provided at the vertically lowest position of said slider when said slider is arranged at an approximately horizontal position.

9. The compression/expansion apparatus as claimed in claim 4, further comprising at least one oil seal member installed in one of said drive section separator, said intermediate chamber separator, and said front chamber separator, said oil seal member having a predetermined clearance for the rod.

10. The compression/expansion apparatus as claimed in claim 9, wherein a portion of the sealing face of said oil seal member has a frusto-conic configuration which is coaxial with the rod and has a larger diameter at the distal end of said oil seal member.

11. The compression/expansion apparatus as claimed in claim 9, further comprising a gas seal member in said working section separator, said gas seal member having a predetermined clearance for the rod.

12. The compression/expansion apparatus as claimed in claim 11, wherein said gas seal member is in tight contact with the rod when the axial length of said intermediate chamber is less than the rod stroke.

13. The compression/expansion apparatus as claimed in claim 11, wherein said gas seal member has a clearance for the rod when the axial length of said intermediate chamber is larger than the rod stroke.

14. The compression/expansion apparatus as claimed in claim 13, wherein said gas seal member has at least one void in the sealing face thereof.

15. The compression/expansion apparatus as claimed in claim 3, wherein said oil return hole is inclined at an angle relative to a horizontal plane so that the oil in said front chamber may flow back to said oil sump under gravitation.

16. The compression/expansion apparatus as claimed in claim 8, wherein said air passage is located at a higher position than said oil return hole so that said oil in said front chamber will not clog said air passage when the oil returns to said oil sump under gravitation.

17. The compression/expansion apparatus as claimed in claim 8, wherein the side wall of said front chamber is inclined relative to the axis of the rod penetrating said front chamber so that oil in the front chamber flow into said oil return hole under gravitation.

18. The compression/expansion apparatus as claimed in claim 17, wherein a portion of the bottom surface of said drive section separator, extending in the axial direction of the rod penetrating said front chamber, is formed to abut on the rod at an acute angle to the axis of the rod so that said portion is capable of wiping off the oil on the rod.

19. A compression/expansion apparatus, comprising:

first and second working sections accommodating first and second reciprocal pistons, respectively, connected with first and second rods, respectively;

a drive section having an oil sump and a drive for said first and second pistons through first and second sliders, respectively, which are connected with the first and second rods, respectively, and guided by first and second slider guides, respectively, for undergoing reciprocal motions;

a separator for separating said working sections from said drive, said separator having penetrating rod holes for receiving therein said reciprocal rods;

a guide space formed in each of said slider guide such that, during said reciprocal motion of the rod, the minimum distance between said slider and said separator is larger than the thickness of the oil layer deposited on said slider so that said oil is prevented from directly touching said rod holes;

an oil return passage in each of said slider guide for allowing the oil accumulating in said guide space to return to said oil sump; and at least an intermediate chamber between said working sections and said drive section, at least said intermediate chamber and said working sections having seal members therebetween.

* * * * *